US010446382B2

(12) United States Patent
Syms

(10) Patent No.: US 10,446,382 B2
(45) Date of Patent: Oct. 15, 2019

(54) MICROENGINEERED SKIMMER CONE FOR A MINIATURE MASS SPECTROMETER

(71) Applicant: Microsaic Systems plc, Woking, Surrey (GB)

(72) Inventor: Richard Syms, London (GB)

(73) Assignee: Microsaic Systems plc, Woking, Surrey (GB)

( * ) Notice: Subject to any disclaimer, the term of this patent is extended or adjusted under 35 U.S.C. 154(b) by 74 days.

(21) Appl. No.: 15/751,401

(22) PCT Filed: Jul. 13, 2016

(86) PCT No.: PCT/EP2016/066689
§ 371 (c)(1),
(2) Date: Feb. 8, 2018

(87) PCT Pub. No.: WO2017/032503
PCT Pub. Date: Mar. 2, 2017

(65) Prior Publication Data
US 2018/0233343 A1 Aug. 16, 2018

(30) Foreign Application Priority Data
Aug. 27, 2015 (GB) ..... 1515217.6

(51) Int. Cl.
*H01J 49/06* (2006.01)
*H01J 49/00* (2006.01)

(52) U.S. Cl.
CPC ..... *H01J 49/067* (2013.01); *H01J 49/0018* (2013.01)

(58) Field of Classification Search
CPC ..... H01J 49/067; H01J 49/0018
See application file for complete search history.

(56) References Cited

U.S. PATENT DOCUMENTS 3,583,633 A 6/1971 Campargue
4,531,056 A 7/1985 Labowsky et al.
(Continued)

FOREIGN PATENT DOCUMENTS

EP 1865533 12/2007
EP 2372745 10/2011
WO 2015040392 3/2015

OTHER PUBLICATIONS

Kistiakowsky G.B., Slichter W.P. "A high intensity source for the molecular beam. Part II Experimental" Rev. Sci. Inst. 22, 333-337 (1951 ).

(Continued)

*Primary Examiner* — Nicole M Ippolito
*Assistant Examiner* — Sean M Luck
(74) *Attorney, Agent, or Firm* — Stephen T. Scherrer; Monique A. Morneault; Scherrer Patent & Trademark Law, P.C.

(57) ABSTRACT

A method for forming a miniature skimmer cone for a free jet expansion vacuum interface is disclosed. The skimmer cone is formed from electroplated metal, deposited inside a blind hole formed on a silicon substrate. The substrate is partially removed to expose the skimmer cone, together with other features formed by etching, and an outlet orifice is formed. A complete miniature vacuum interface is formed from the stacked assembly of a part containing an inlet orifice, a spacer, and the part containing a skimmer cone described above, mounted in an intermediate pressure chamber at the inlet to a mass spectrometer.

15 Claims, 5 Drawing Sheets

(56) References Cited

U.S. PATENT DOCUMENTS

| | | | | |
|---|---|---|---|---|
| 4,926,056 | A * | 5/1990 | Spindt | H01J 9/02 164/46 |
| 5,440,124 | A * | 8/1995 | Kelly | H01J 37/285 250/287 |
| 7,038,217 | B2 * | 5/2006 | Yamada | H01J 49/0422 250/288 |
| 7,786,434 | B2 | 8/2010 | Syms et al. | |
| 7,922,920 | B2 | 4/2011 | Harpold et al. | |
| 2002/0000516 | A1 | 1/2002 | Schultz et al. | |
| 2003/0122069 | A1 * | 7/2003 | Kato | H01J 49/0404 250/288 |
| 2014/0361163 | A1 * | 12/2014 | Taniguchi | H01J 49/063 250/287 |

OTHER PUBLICATIONS

Deckers J., Fenn J.B. "High intensity molecular beam apparatus" Rev. Sci. Inst. 34, 96-100 (1963).

Campargue R. "High intensity supersonic molecular beam apparatus" Rev. Sci. Inst. 35, 1 1 1-1 12 (1964).

Gentry W.R., Giese C.F. "High-precision skimmers for supersonic molecular beams" Rev. Sci. Inst. 46, 104 (1975).

Yamashita M., Fenn J.B. "Electrospray ion source. Another variation on the free-jet theme" J.Phys. Chem. 88, 4451-4459 (1984).

Bruins A.P., Covey T.C., Henion J.D. "Ion spray interface for combined liquid chromatography/ atmospheric pressure ionization mass spectrometry" Anal.Chem. 59, 2642-2646 (1987).

Grams M.P., Cook A.M., Turner J.H., Doak R.B. "Microscopic fused silica capillary nozzles as supersonic molecular beam sources" J. Phys. D. Appl. Phys. 39, 930-936 (2006).

Kuo C.-L, Masuzawa T., Fujino M. "High-precision micronozzle fabrication" Proc. IEEE Int. Conf. on Micro-Electro-mechanical systems, Travemunde, Germany, Feb. 4-7, pp. 1 16-121 (1992).

Mukherjee E.V., Wallace A.P., Yan K.Y., Howard D.W., Smith R.L., Collins S.D. "Vaporizing liquid microthruster" Sensors and Actuators 83, 231-236 (2000).

Wang L, Stevens R., Malik A., Rockett P., Paine M., Adkin P., Martyn S., Smith K., Stark J., Dobson P. "High aspect ratio silica nozzle fabrication for nano-emitter electrospray applications" Microelectr. Engng. 84, 1 190-1 193 (2007).

Wright S., Syms R.R.A., Moseley R.W., Hong G., O'Prey S., Boxford W.E., Dash N., Edwards P. "MEMS-based nanospray ionisation mass spectrometer" IEEE J. Microelectromech. Syst. 19, 1430-1443 (2010).

Malcolm A., Wright S., Syms R.R.A., Moseley R.W., O'Prey S., Dash N., Pegus A., Crichton E., Hong G., Holmes A.S., Finlay A., Edwards P., Hamilton S.E., Welch C.J. "A miniature mass spectrometer for liquid chromatography applications" Rapid Comm. in Mass Spectrom. 25, 3281-3288 (2011).

* cited by examiner

MICROENGINEERED SKIMMER CONE FOR A MINIATURE MASS SPECTROMETER

TECHNICAL FIELD OF THE INVENTION

This invention relates to mass spectrometry, and in particular to the use of mass spectrometry in conjunction with liquid chromatography or capillary electrophoresis with an electrospray ionization source. The invention more particularly relates to a microengineered interface for use in a mass spectrometry system.

BACKGROUND

Identification of a chemical substance is often carried out using a combination of separation and analysis. Separation of a liquid analyte into its different components is commonly carried out using liquid chromatography (LC) or capillary electrophoresis (CE). To minimise ion fragmentation, analysis is carried out by first ionizing the liquid at atmospheric pressure using an electrospray ionization (ESI) source. However, analysis typically takes place under vacuum, using a mass spectrometer (MS). The ions, which normally comprise a small fraction of an entraining gas flow, must therefore be coupled between regions at atmospheric pressure and at low pressure. Coupling between the two pressure regimes is carried out in an intermediate pressure chamber known as a vacuum interface.

Efficient vacuum interfaces subject the gas and ion flow to an adiabatic compression-expansion process, of the type originally developed for the production of cluster beams [Kistiakowsky 1951; Deckers 1963; Campargue 1964; U.S. Pat. No. 3,583,633] and known as a free jet expansion. Such systems were later adapted to ESI-MS systems [Yamashita 1984; Bruins 1987; U.S. Pat. No. 453,056]. In any such process, supersonic velocities can be achieved, effectively by trading the thermal energy of ions and molecules for kinetic energy in the forward direction. As a result, the flow becomes collimated, allowing a considerable improvement in coupling efficiency into any downstream analysis device such as a mass filter.

A common method of free jet expansion involves expansion of the flow into an intermediate pressure chamber. The gas entering the chamber forms a barrel-shaped volume known as a shock bottle, bounded by oblique shock waves, at the end of which is located a normal shock known a Mach disc. Experiments have shown that, if the Mach disc can be punctured using a sharp conical metal skimmer, the flow through the skimmer orifice can undergo further shock-free expansion into a low-pressure chamber and hence remains collimated.

A key requirement is the ability to construct intermediate chambers with suitable input orifices and skimmer cones. Large metal skimmer cones can be fabricated using conventional machining. Smaller cones can be formed by electroplating layers of metal on the outside of a suitably shaped mandrel, machining away the tip to form an orifice, and detaching the electroplated structure using thermal shock [Gentry 1975]. The cone may then be attached to a bulkhead between the intermediate and low-pressure chambers. However, as systems become miniaturised, it becomes increasingly difficult to form suitable skimmer components with sufficient precision. Microfabrication methods such as electro-discharge-machining (EDM) may be used for the initial shaping [Kuo 1992]. Tapered skimmers with microscopic orifices may be constructed from melted and stretched silica capillaries [Grams 2006]. However, these methods yield discrete components that require alignment and attachment to pressure bulkheads.

In alternative applications, miniature nozzle components have been fabricated by etching pyramidal shaped holes in silicon substrates using anisotropic wet chemical etching [Mukherjee 2000]. However, the application was a microthruster, and cone-shaped skimmers were not formed. Microfabricated nozzles have also been fabricated by first etching a stepped hole in a silicon substrate by deep reactive ion etching (DRIE), forming a layer of silicon dioxide, and partly removing the silicon to reveal the silicon dioxide [Wang 2007]. However, the application was an electrospray source and smooth tapered features were not formed.

Vacuum interface components have been also formed in silicon. U.S. Pat. No. 7,786,434 described a silicon-based vacuum interface, formed by structuring silicon using plasma-based deep reactive ion etching (DRIE) and stacking etched dies together to form a complete intermediate chamber with aligned entrance and exit orifices. Similar components have been incorporated into miniature ESI-MS systems [Wright 2010; Malcolm 2011]. However, the design lacked a suitably shaped skimmer cone and instead used an etched capillary outlet, leading to a significant reduction in useful ion coupling efficiency. U.S. Pat. No. 7,922,920 described a similar interface component formed from stacked silicon dies, incorporating meandered input channels but again lacking a skimmer cone.

Accordingly there is a need to develop new methods capable of combining miniature skimmer cones with the other components needed to construct complete miniature vacuum interfaces capable of providing shock-free supersonic expansions.

SUMMARY OF THE INVENTION

These and other problems are addressed in accordance with the present teaching by method and device as detailed in the claims that follow. As will be appreciated from the following, the present teaching provides a method of combining a miniature skimmer cone with the back-plate of a miniature vacuum interface formed in silicon. When combined a front-plate carrying a suitable input orifice, and other components capable of acting as spacers, this allows construction of a complete miniature vacuum interface. The components may be fabricated in wafer-scale batches and then separated into individual dies to allow low cost fabrication of precision miniature components. These and other features will be appreciated with reference to the following detailed description which is provided to assist in an understanding of the present teaching.

DETAILED DESCRIPTION OF THE DRAWINGS

Figure 1:
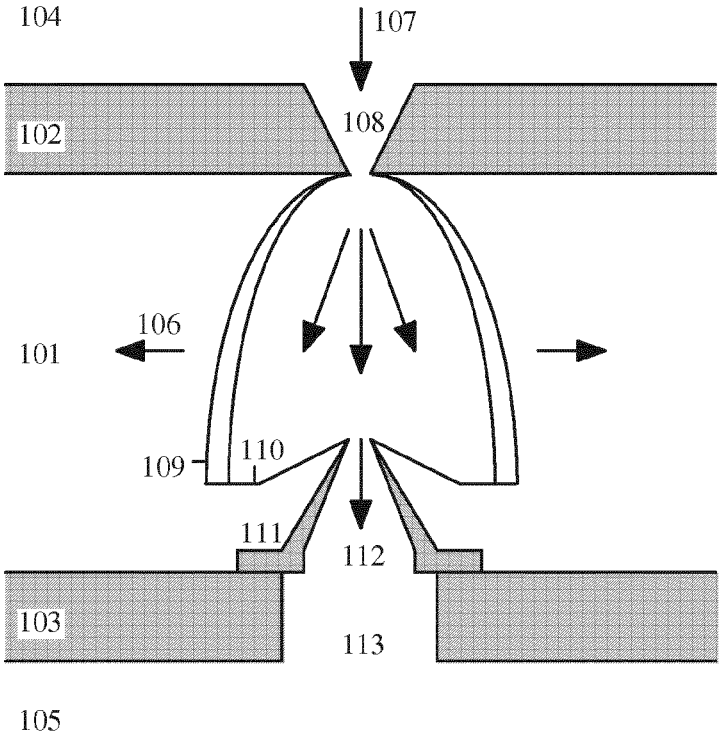
PRIOR ART Figure 1
FIG. 1 shows a vacuum interface for a mass spectrometer, according to the prior art.

FIG. 1 shows a conventional vacuum interface according to the prior art. An intermediate pressure chamber 101 defined by two bulkheads 102 and 103 between a high-pressure region 104 and a low-pressure region 105 is held at suitable pressure by pumping, indicated generally as the gas flow 106. Gas and entrained ions enter as a stream 107 through an input orifice 108. On entering the chamber, the flow forms a barrel shock 109, located at the base of which is a normal shock 110 known as a Mach disc, whose axial position is dependent on the pressure in the intermediate chamber. The pressure is chosen to extend the barrel shock far enough that the Mach disc may be punctured by a sharp skimmer cone 111 attached to the rear bulkhead 103. The flow 112 may then pass through an orifice at the tip of the skimmer 111 and though a further orifice in the rear bulkhead 113 into the low-pressure region 105 without further shocks. The dimensions of these known structures are typically millimetric.

The arrangement of FIG. 1 is formed from discrete parts which are assembled after fabrication to form the final structure.

Figure 2:
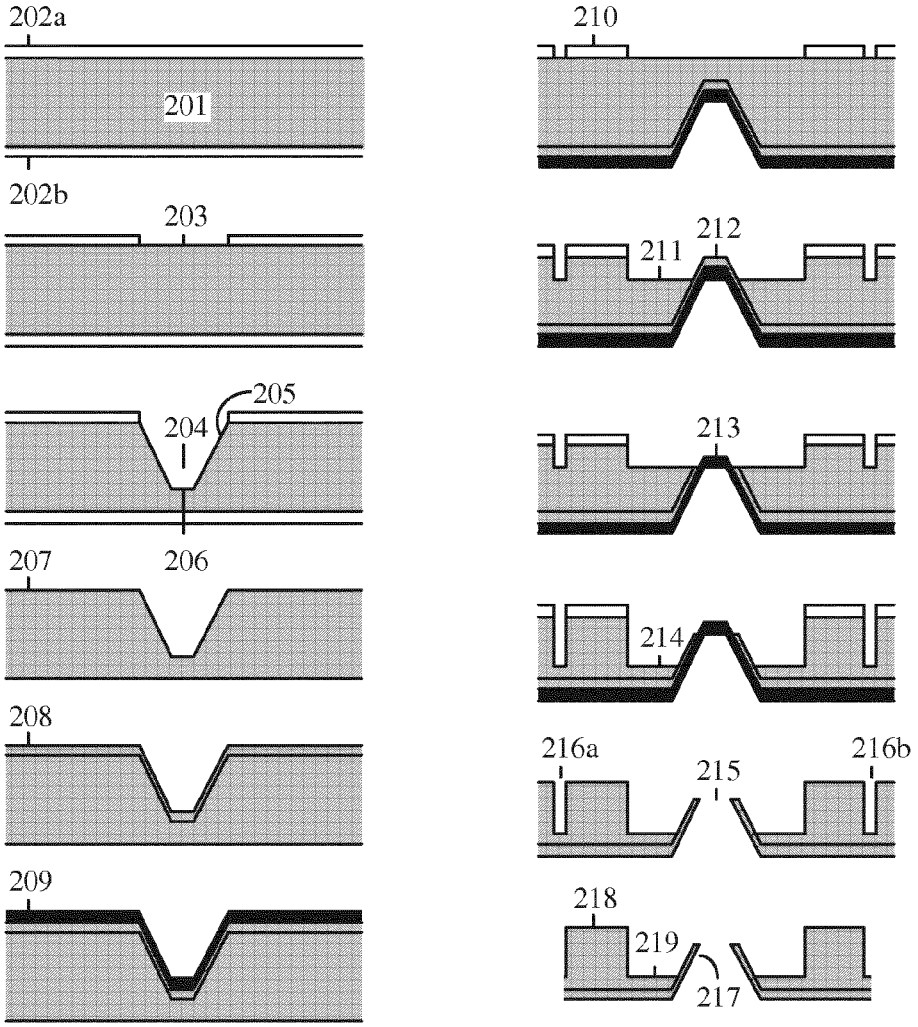
FIG. 2 shows an example microfabrication process for combining miniature skimmer cones formed in electroplated metal with other etched features on a silicon substrate, according to the present invention.

In accordance with the present teaching it is possible to fabricate a plurality of components in an integrated fashion so as to allow fabrication of a miniaturised structure. FIG. 2 shows an example of how such a miniaturised skimmer cone may be fabricated on a substrate together with other miniaturised structures, according to the present invention. The starting point is a substrate 201, which is desirably polished on both sides. An example of a suitable substrate material is (100)-oriented single crystal silicon. The substrate is coated on both sides with layers of material 202*a*, 202*b* that can act as a mask against subsequent etching. An example of a suitable masking layer is silicon nitride ($Si_3N_4$), and an example of a suitable deposition process is low-pressure chemical vapour deposition (LPCVD). The masking layer is patterned and etched on one side to form an opening 203, which in this example is desirably provided having a square geometry. An example of a suitable patterning process is lithographic exposure of a spin-coated layer of photoresist, and an example of a suitable etching process is reactive ion etching (RIE) followed by removal of the photoresist layer.

The substrate is then immersed in a wet chemical etchant, whose operation is to etch down crystal planes. An example of a suitable etchant is potassium hydroxide (KOH); alternatives include tetramethyl ammonium hydroxide (TMAH). The action of the etchant is to form a square conical hole 204 in the region of the opening 203, whose sidewalls 205 belong to the family of <111> crystal planes and form an angle $\cos^{-1}(1/\sqrt{3})=54.536$ degrees with the substrate surface. If the etching is carried out for a limited time, the hole will be blind, and the dimension at the base 206 will depend on the dimension of the mask opening 203 and the depth of etching. As a result, a suitable base dimension can be achieved by controlling the etching depth. For standard substrates, the etch depth may easily be several hundred microns. After completion of etching, the surface mask can be removed from both sides to reveal the substrate surface 207.

The etched side of the substrate is then coated with a semi conformal layer of material 208 that will eventually form the skimmer cone. An example of a suitable material is nickel, and an example of a suitable coating process is radio frequency (RF) sputter deposition of a thin adhesion layer and a thin nickel layer to act as a seed, followed by electroplating of a thicker nickel layer. The thick nickel layer is desirably several microns thick. A further thin layer 209 is then deposited to act as an etch stop against subsequent etching. An example of a suitable etch stop layer is titanium and gold, both deposited by RF sputtering. It will be appreciated that the metal layers together then form a blind, thin-walled conical pyramid.

The substrate is then turned over, and a thick layer of photoresist 210 is deposited and patterned lithographically to form a further mask for etching. The features thus defined can include mechanical supports and channels for gas pumping. The exposed substrate surface 211 is then anisotropically etched, to a depth that just reveals the blind tip 212 of the conical metal pyramid. An example of a suitable etching process is deep reactive ion etching, a form of plasma etching that uses inductively coupled plasma etching to remove material rapidly. The nickel layer across the blind tip is then removed by etching the exposed metal in a wet etchant, using the layer 213 as an etch stop. Further anisotropic etching is then carried out until the exposed substrate surface 214 has been lowered to a depth sufficient to achieve a desired height for the skimmer cone. The surface mask 210 and the etch-stop layer 213 are then removed, to leave an opening 215 in the skimmer cone. Dies are then separated along the example lines 216*a*, 216*b* to leave a completed part containing a skimmer cone 217 and other etched features 218 supported on a thinned substrate 219. Examples of suitable die singulation processes include cleaving, dicing and laser scribing.

Figure 3:
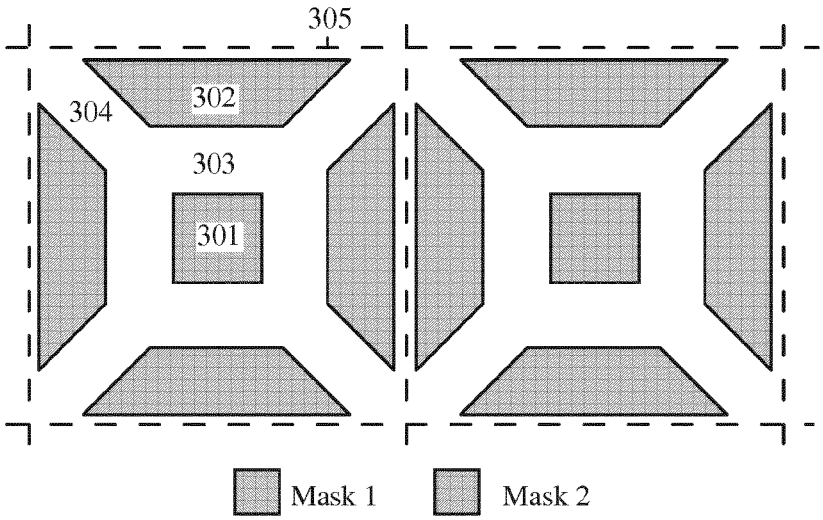
FIG. 3 shows an example layout for a two-mask set of photomasks, designed to combine miniature skimmer cones formed in electroplated metal with other etched features on a silicon substrate, according to the present invention.

FIG. 3 shows the layout of a two-mask set of photomasks that can combine a miniaturised skimmer cone with other miniaturised structures on a substrate, according to the present invention. The location of the skimmer cone is the square feature 301 on Mask 1. This feature provides the opening that is etched to form a blind pyramidal hole during the first etching step, and is subsequently replicated by electroplating to form the skimmer cone. The dimensions of this feature are chosen to achieve a suitable tip dimension. The feature 301 is surrounded with other features 302 on Mask 2, which define regions of the silicon substrate that are protected during the second etching step. These features will form raised spacer parts that surround the skimmer cone, and the space 303 between the features 301 and 302 therefore defines part of the intermediate pressure chamber in a complete vacuum interface. Similarly, the space 304 between any two features 302 can be used to define a channel through which gas can be pumped out of the intermediate chamber. The dashed lines 305 define cleaving or dicing lanes that allow a wafer containing a set of repetitions of similar patterns to be separated into dies containing a set of features 301-304.

Figure 4:
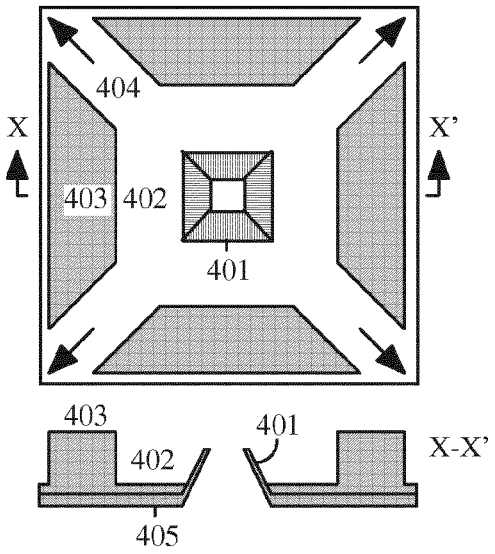
FIG. 4 shows a plan and section view of a completed skimmer cone part, fabricated according to the process shown in FIG. 2 and mask layout of FIG. 3, according to the present invention.

FIG. 4 shows a plan and section view of a completed skimmer cone part, fabricated using the process in FIG. 2 and mask layout in FIG. 3, according to the present invention. The skimmer cone 401 is surrounded with a set of raised parts 403 that define a region 402 forming part of the intermediate pressure chamber and a set of gas pumping channels 404. The skimmer cone and other parts are integrally mounted on a substrate 405 that can act as a pressure bulkhead.

Figure 5:
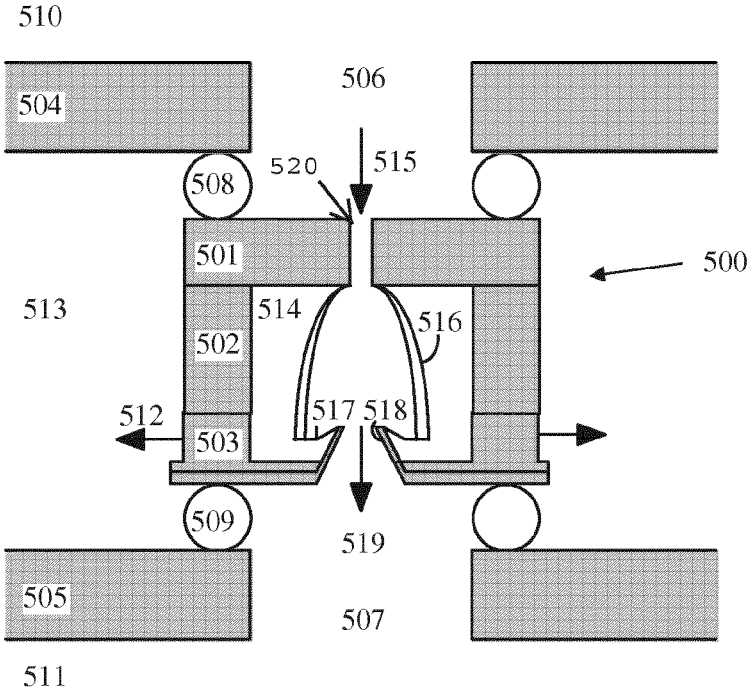
FIG. 5 shows a miniature vacuum interface for a mass spectrometer, formed from an orifice part, a spacer part and a skimmer cone part, stacked together and mounted in an evacuated space between two conventional metal supports, according to the present invention.

FIG. 5 shows a miniature vacuum interface 500 for a mass spectrometer, according to the present invention. The miniature or microengineered vacuum interface 500 comprises a housing having side walls 501, 502, 503 defining an interior volume 514 of the housing. A first side wall defines a part 501 defining an input orifice 520 to the interior volume and a second wall 503, opposite the first wall 501, defines an exit orifice from the interior volume 514. The input orifice and exit orifice operably facilitate the passage of a gas through the interior volume 514. The dimensions of these orifices are typically of the order of microns—for example 100 μm.

The interface 500 further comprises a skimmer cone 518 integrally formed and extending inwardly from the second wall 503—as described above with reference to FIG. 4—into the interior volume 514, the skimmer cone defining an entrance from the interior volume to the exit orifice. The distance between the first 501 and second 502 side walls is defined by the dimensions of bulkheads 502 which extend about the interior volume 514. The bulkheads include gas orifices, described as the pumping channels 404 in FIG. 4, which facilitate a pumping of the interior volume 514, as indicated by the gas flow 512 so that the regions 513 and 514 are held at intermediate pressure relative to the high pressure 510 and low pressure 511. (It will be appreciated that apart from any differential resultant from pumping restrictions that the pressures in each of regions 513, 514 are substantially equivalent.) Operably, a gas stream containing entrained ions 515 entering through the input orifice 520 to the interface 500 will form a barrel shock 516 in the interior volume 514 defined by the side walls of the housing. If the intermediate pressure within this volume is sufficiently low, the barrel shock will be extended far enough that the Mach disc 517 may be punctured by the skimmer cone 518, allowing the flow 519 to pass through the skimmer cone 518 and into the low-pressure region 511 without further shocks.

It will be appreciated that the arrangement of FIG. 5 incorporates an electroplated conical structure which forms a skimmer cone and which is formed on the inside of a tapered blind hole rather than on the outside of a tapered mandrel. It is evident from an inspection of the skimmer cone of FIG. 5, that the skimmer cone provides non-parallel side walls. By providing these tapered inner walls which define a passage for the gas to exit, the skimmer cone allows further expansion of the gas from the interior volume to an exterior volume at a reduced pressure. A cone per the present teaching is formed on the inside of a tapered blind hole and provides tapered inner side walls that converge towards one another in the direction towards the interior volume 514 of the interface.

It will be further appreciated that formation of the exit orifice involves etching rather than conventional machining, and removal of the mould involves etching rather than detachment. As a result, the process yields a skimmer cone attached to a thinned substrate that can act as a pressure bulkhead and which forms an integral structure. It will also be appreciated that the bulkhead can carry other features needed in a complete vacuum interface such as mechanical supports and gas pumping channels.

In use the interface component is stacked together and mounted between pressure bulkheads 504 and 505 containing holes 506 and 507 using O-ring seals 508 and 509. The complete interface 500 lies between a high-pressure region 510 provided to a first side of the bulkhead 504 and a low-pressure region 511 provided to a first side of the bulkhead 505. In this way, it will be appreciated that the high and low pressure regions are provided on outer sides of each of the bulkheads 504, 505 whereas the interface is provided between the inner sides of each of the bulkheads 504, 505. It will be appreciated that the seals 508 are examples of resilient seals which are received and retained by the interface so as to allow a location of the interface between the first and second pressure bulkheads 504, 505. It will be appreciated that the formed vacuum interface provides a region of intermediate pressure between a high pressure region—typically atmospheric pressure—and a low pressure region—typically vacuum conditions—within which a mass spectrometer may be operated. In this way the interface with the formed skimmer provides a path to the inlet of a mass spectrometer. In use, the complete miniature vacuum interface as formed from the stacked assembly of a part containing an inlet orifice, a spacer, and the part containing a skimmer cone described above is mounted in an intermediate pressure chamber at the inlet to a mass spectrometer.

It will be appreciated that variants on the processing sequence described above may be used to achieve a substantially similar result. For example, it will be appreciated that processes other than crystal plane etching may be used to form the blind conical. Suitable processes include laser ablation. In this case a skimmer cone with cylindrical pyramidal shape will be obtained; this may be advantageous in reducing downstream shock formation.

It will also be appreciated that metals other than nickel that may also be deposited by electroplating may also be suitable for formation of the cone. Suitable metals include copper. It will also be appreciated that metals such as tungsten that may be deposited by chemical vapour deposition may also be suitable. In this way it will be appreciated that the present teaching is not intended to be limited to any one set of materials or components as departures from the explicit examples described herein will be appreciated by those or ordinary skill in the art.

It will also be appreciated that processes other than etching may be used to reveal the tip of the cone and open its orifice. Suitable processes include chemical mechanical polishing. However, in this case the second lithography step must be carried out after completion of polishing.

Finally it will be appreciated that alternative mask materials may be used. For example, the silicon nitride layer used as a mask against KOH etching may be replaced with silicon dioxide. Similarly, the silicon nitride layer may be retained as a mask during etching of the second set of features, or other masking layers more resilient to etching may be used.

It will be appreciated that the term the term microengineered refers to components that have dimensions of the order of micrometers. Devices per the present teaching may be fabricated using micro system technology and may be considered microelectromechanical (MEMS) type systems.

While exemplary arrangements have been described herein to assist in an understanding of the present teaching it will be understood that modifications can be made without departing from the scope of the present teaching. To that end it will be understood that the present teaching should be construed as limited only insofar as is deemed necessary in the light of the claims that follow. Furthermore, the words comprises/comprising when used in this specification are to specify the presence of stated features, integers, steps or components but does not preclude the presence or addition of one or more other features, integers, steps, components or groups thereof.

REFERENCES CITED

Kistiakowsky G. B., Slichter W. P. "A high intensity source for the molecular beam. Part II Experimental" Rev. Sci. Inst. 22, 333-337 (1951)

Deckers J., Fenn J. B. "High intensity molecular beam apparatus" Rev. Sci. Inst. 34, 96-100 (1963)

Campargue R. "High intensity supersonic molecular beam apparatus" Rev. Sci. Inst. 35, 111-112 (1964)

Gentry W. R., Giese C. F. "High-precision skimmers for supersonic molecular beams" Rev. Sci. Inst. 46, 104 (1975)

Yamashita M., Fenn J. B. "Electrospray ion source. Another variation on the free-jet theme" J. Phys. Chem. 88, 4451-4459 (1984)

Bruins A. P., Covey T. C., Henion J. D. "Ion spray interface for combined liquid chromatography/atmospheric pressure ionization mass spectrometry" Anal. Chem. 59, 2642-2646 (1987)

Grams M. P., Cook A. M., Turner J. H., Doak R. B. "Microscopic fused silica capillary nozzles as supersonic molecular beam sources" J. Phys. D. Appl. Phys. 39, 930-936 (2006)

Kuo C.-L., Masuzawa T., Fujino M. "High-precision micronozzle fabrication" Proc. IEEE Int. Conf. on Micro-Electro-mechanical systems, Travemünde, Germany, February 4-7, pp. 116-121 (1992)

Mukherjee E. V., Wallace A. P., Yan K. Y., Howard D. W., Smith R. L., Collins S. D. "Vaporizing liquid micro-thruster" Sensors and Actuators 83, 231-236 (2000)

Wang L., Stevens R., Malik A., Rockett P., Paine M., Adkin P., Martyn S., Smith K., Stark J., Dobson P. "High aspect ratio silica nozzle fabrication for nano-emitter electrospray applications" Microelectr. Engng. 84, 1190-1193 (2007)

Wright S., Syms R. R. A., Moseley R. W., Hong G., O'Prey S., Boxford W. E., Dash N., Edwards P. "MEMS-based nanospray ionisation mass spectrometer" IEEE J. Microelectromech. Syst. 19, 1430-1443 (2010)

Malcolm A., Wright S., Syms R. R. A., Moseley R. W., O'Prey S., Dash N., Pegus A., Crichton E., Hong G., Holmes A. S., Finlay A., Edwards P., Hamilton S. E., Welch C. J. "A miniature mass spectrometer for liquid chromatography applications" Rapid Comm. in Mass Spectrom. 25, 3281-3288 (2011)

US PATENT DOCUMENTS CITED

U.S. Pat. No. 3,583,633 Campargue May 6, 1969.

U.S. Pat. No. 4,531,056 Labowsky et al. Jul. 23, 1985

U.S. Pat. No. 7,786,434 Syms et al. Aug. 31, 2010

U.S. Pat. No. 7,922,920 Harpold et al. Apr. 12, 2011

The invention claimed is:

1. A method of forming a microengineered vacuum interface comprising a housing having side walls defining an interior volume of the housing, a first wall of the housing defining an input orifice to the interior volume and a second wall, opposite the first wall defining an output orifice to the interior volume, the second wall comprising an open hollow skimmer cone on a substrate, the method comprising:

depositing a layer of material inside a blind tapered hole in the substrate, removing surrounding substrate material to reveal the cone, the cone having tapered inner and tapered outer surfaces, forming an orifice at the tip of the cone; and coupling the second wall to the first wall to define the housing, the skimmer cone defining a conical structure extending inwardly into the housing and wherein the orifice at the tip of the cone forms and entrance from the interior volume to the exit orifice.

2. The method of claim 1, in which the substrate is silicon.

3. The method of claim 1 comprising forming the blind tapered hole by anisotropic chemical etching.

4. The method of claim 1 comprising forming the blind tapered hole by laser ablation.

5. The method of claim 1 wherein the deposited material is a metal.

6. The method of claim 5 wherein the deposited metal is nickel or copper.

7. The method of claim 1 comprising depositing the layer of material by electroplating.

8. The method of claim 1 comprising depositing the layer of material by chemical vapour deposition.

9. The method of claim 1 comprising revealing the tip of the cone by etching.

10. The method of claim 1 comprising revealing the tip of the cone by chemical mechanical polishing.

11. The method of claim 1 wherein the orifice is formed by etching.

12. The method of claim 1 wherein the orifice is formed by chemical mechanical polishing.

13. The method of claim 1 comprising structuring the substrate to form support features.

14. The method of claim 1 comprising forming gas pumping channels in the substrate.

15. The method of claim 1 further comprising combining the formed interface component with a front part containing an inlet orifice and a spacer part to form a complete vacuum interface.

* * * * *